US011419438B2

(12) United States Patent
Zamora et al.

(10) Patent No.: US 11,419,438 B2
(45) Date of Patent: Aug. 23, 2022

(54) AROMATHERAPY PILLOW

(71) Applicant: GRAVITY BRAND HOLDINGS LLC, New York, NY (US)

(72) Inventors: Karalyn Margaret Zamora, Brooklyn, NY (US); Lucas Lerman Lappe, Brooklyn, NY (US); Alexandra Elena Garey, Brooklyn, NY (US)

(73) Assignee: GRAVITY BRAND HOLDINGS LLC, New York, NY (US)

( * ) Notice: Subject to any disclaimer, the term of this patent is extended or adjusted under 35 U.S.C. 154(b) by 200 days.

(21) Appl. No.: 16/719,808

(22) Filed: Dec. 18, 2019

(65) Prior Publication Data

US 2021/0186235 A1 Jun. 24, 2021

(51) Int. Cl.
*A47G 9/00* (2006.01)
*A47G 9/10* (2006.01)

(52) U.S. Cl.
CPC ..... *A47G 9/007* (2013.01); *A47G 9/1045* (2013.01); *A47G 2009/1018* (2013.01)

(58) Field of Classification Search
CPC ..... A47G 9/007; A47G 9/1045; A47G 2009/1018; A61L 9/12
See application file for complete search history.

(56) References Cited

U.S. PATENT DOCUMENTS 3,964,684 A * 6/1976 Schimanski ..... A61L 9/12 239/56
4,161,284 A * 7/1979 Rattan ..... A61L 9/12 239/43
4,345,716 A * 8/1982 Armstrong ..... A61L 9/12 239/56
4,502,630 A * 3/1985 Haworth ..... A61L 9/12 239/34
4,660,763 A * 4/1987 Gutkowski ..... A61L 9/12 239/121
4,854,501 A * 8/1989 Ricci ..... A61L 9/12 239/54
5,299,335 A * 4/1994 Ivester ..... A47C 27/001 128/202.18
6,430,764 B1 * 8/2002 Peters ..... A47G 9/007 5/641
8,978,178 B2 * 3/2015 Batiste ..... A61F 7/02 5/490
10,022,003 B1 * 7/2018 Edoria ..... G08B 6/00
2006/0157578 A1 * 7/2006 Harada ..... A61L 9/12 239/36

(Continued)

FOREIGN PATENT DOCUMENTS

CA 2283343 A1 * 10/1998 ..... A61L 9/12
CA 2662806 C * 4/2010 ..... A61L 9/12

(Continued)

*Primary Examiner* — David R Hare
*Assistant Examiner* — Alexis Felix Lopez
(74) *Attorney, Agent, or Firm* — Bochner IP, PLLC; Andrew D. Bochner

(57) ABSTRACT

An aromatherapy system is created including a scent cartridge, puck, and pillow. A scent cartridge may be a disposable cartridge for diffusing scented fluid, such as essential oils, through a pillow. A scent cartridge may be orientated within a puck, such that the puck may support the scent cartridge within a pillow while preventing the scent cartridge from directly contacting fill of the pillow.

13 Claims, 10 Drawing Sheets

(56) References Cited

U.S. PATENT DOCUMENTS

| | | | | |
|---|---|---|---|---|
| 2010/0308130 | A1* | 12/2010 | Gruenbacher | A61L 9/127 239/34 |
| 2011/0180621 | A1* | 7/2011 | Gruenbacher | A61L 9/12 239/34 |
| 2013/0091629 | A1* | 4/2013 | Eaton | A47G 9/007 5/490 |
| 2020/0069086 | A1* | 3/2020 | Little | B68G 1/00 |
| 2020/0405999 | A1* | 12/2020 | Goodstadt | A47C 31/005 |
| 2021/0138184 | A1* | 5/2021 | Lois | A61M 21/02 |

FOREIGN PATENT DOCUMENTS

| | | | | | |
|---|---|---|---|---|---|
| CN | 109276098 | A | * | 1/2019 | |
| ES | 1069438 | U | * | 3/2009 | |
| GB | 2385271 | A | * | 8/2003 | A47G 9/007 |
| GB | 2385271 | A | | 8/2003 | |
| KR | 20030088601 | A | * | 11/2003 | |
| KR | 20170001505 | A | * | 1/2017 | |
| KR | 20170001510 | A | * | 1/2017 | |
| KR | 20170001518 | A | * | 1/2017 | |
| KR | 20180004513 | A | * | 1/2018 | |
| NL | 1013813 | C2 | * | 6/2000 | A61K 9/007 |
| NL | 1013813 | C2 | | 6/2000 | |
| WO | 2006079171 | A1 | | 8/2006 | |
| WO | WO-2006079171 | A1 | * | 8/2006 | A61L 9/042 |

* cited by examiner

AROMATHERAPY PILLOW

CROSS REFERENCE TO RELATED APPLICATIONS

This application incorporates by reference for all purposes the full disclosure of co-pending U.S. Design application No. 29/717,701, filed concurrently herewith, entitled "AROMATHERAPY DEVICE".

BACKGROUND

Aromatherapy is popular throughout the world. However, it is difficult for many people to find time to utilize scented mechanisms for lengthy periods. Generally speaking, techniques to deliver specific doses are imprecise and require user measurement, involving a lot of attention which can frustrate users and detract from the efficacy of aromatherapy. Alternative techniques can require powered machines to distribute timed quantities of scented oils, where, in addition to the complexity in maintenance and use associated with machinery, the associated noise of the powered machines detracts from the efficacy of aromatherapy.

BRIEF DESCRIPTION OF THE DRAWINGS

Various techniques will be described with reference to the drawings, in which.

DETAILED DESCRIPTION

Figure 1:
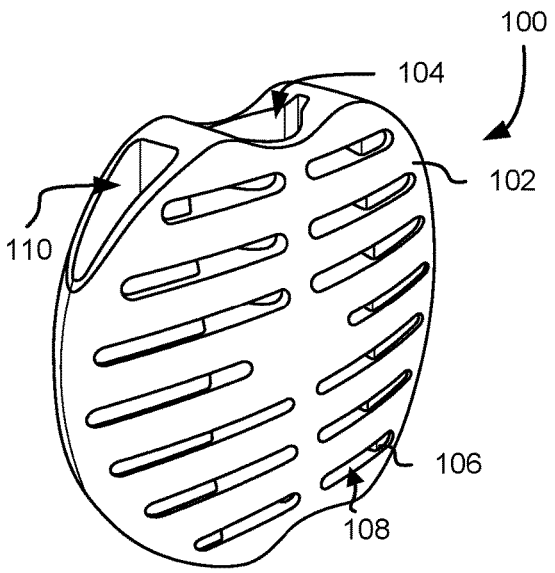
FIG. 1 is a front perspective view of a puck structure in accordance with an embodiment.

Techniques and systems described herein relate to aromatherapy delivery devices that includes a pillow that accommodates a scent cartridge. In some examples, a puck structure supports a scent cartridge to diffuse scented fluid through a pillow structure. Various details are set forth describing specific structures associated with delivering a scented fluid, including configurations of a puck structure, a cartridge structure, a pillow structure, a pillow case structure, etc. in order to provide a thorough understanding of the present disclosure.

Such pillow case structures contemplated as being within the scope of the present disclosure may be configured to function with various pillow structures with particulate fill. For example, shredded memory foam, down feather, and alternative/synthetic down feather fill may serve as suitable fill for a pillow structure to accommodate a scent cartridge. As one skilled in the art will appreciate in light of this disclosure, such pillow structured contemplated in this disclosure may be adapted for accommodating various aromatherapy delivery devices. It should also be understood that there is no intention to limit the pillow structures to a specific form or forms disclosed for use with such cartridge structures and puck structures disclosed herein; but, on the contrary, the intention is to cover all modifications, alternative constructions, and equivalents falling within the spirit and scope of the present disclosure, as defined in the appended claims.

Various examples described below relate to a puck structure for use with aromatherapy. In an example, pillow structures are configured with spaces defined to accommodate a puck structure. A puck structure may be configured to receive scented fluid. Scented fluid may be contained in a capsule that is accommodated by a puck structure. A puck structure may provide a medium by which to support a scent cartridge within a pillow structure. A puck structure may support a scent cartridge permeated with scented fluid such that the scented fluid may be aerated, diffused, or broadcast at least within a pillow structure without the permeated scent cartridge directly contacting fill of the pillow structure, such as shredded memory foam.

In an example, cartridge structures contain and dispense scented fluid. In an example, a cartridge structure is comprises a capsule filled with scented fluid. The capsule may be encompassed by an absorbent or permeable material, such as a natural or synthetic cloth. The capsule may be encompassed by multiple layers of an absorbent or permeable material. Multiple layers of absorbent material increase the volume by which scented fluid may be absorbed. The capsule may be configured such that when the capsule is compressed or crushed, the contents of the capsule may be dispersed into the surrounding absorbent material.

In the preceding and following description, various techniques and systems are described. For purposes of explanation, specific configurations and details are set forth in order to provide a thorough understanding of possible ways of implementing the techniques and systems. It will also be apparent that the techniques and systems described may be practiced in different configurations without the specific details. Furthermore, well-known features of certain structures, such as pillow structures, may be omitted or simplified to avoid obscuring the techniques and systems being described. Examples should be taken as being illustrative in nature and not limiting to the scope of the disclosure.

As one skilled in the art will appreciate in light of this disclosure, certain embodiments may be capable of achieving certain advantages, including some or all of the following: improve delivery of aromatherapy scents; reduce proximity between an aromatherapy device and an operator; reduce complexity of measuring aromatherapy scented fluids.

Figure 2:
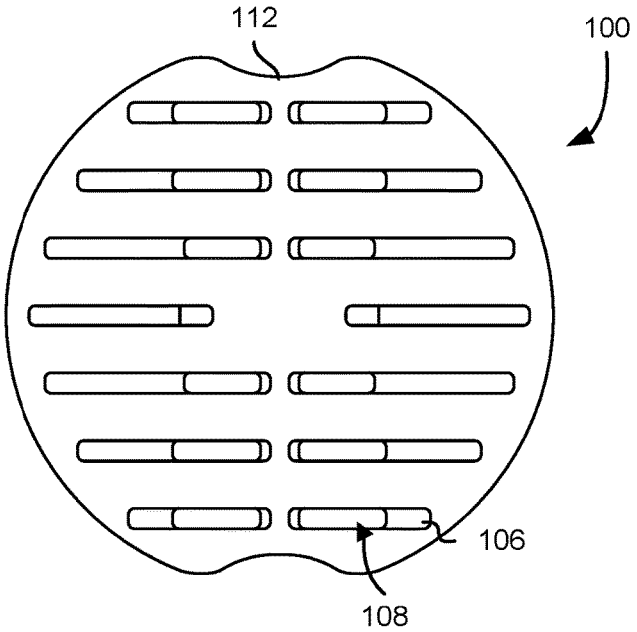
FIG. 2 is a front view of a puck structure in accordance with an embodiment.
Figure 3:
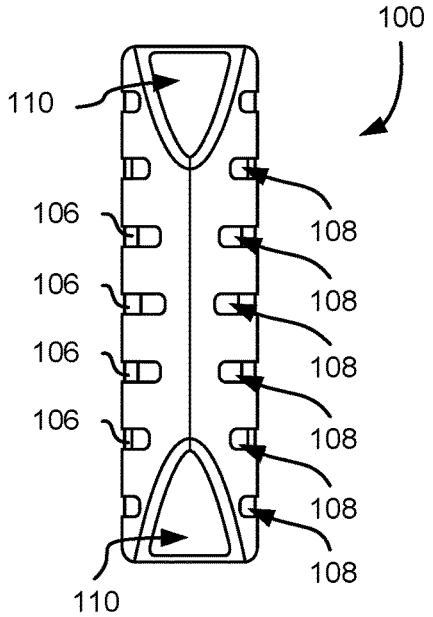
FIG. 3 is a side view of a puck structure in accordance with an embodiment.
Figure 4:
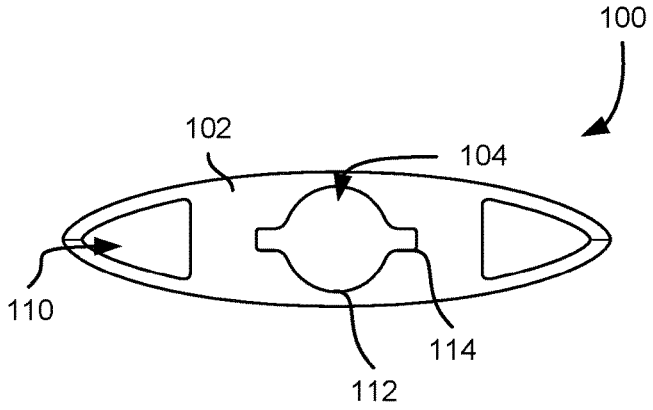
FIG. 4 is a top view of a puck structure in accordance with an embodiment.

FIG. 1 is a front perspective view of a puck structure 100 in accordance with at least one embodiment. The puck structure 100 may be molded from a material that retains shape but is also flexible, such as silicone. In an embodiment, a puck structure 100 may be formed by a material providing a smooth surface, such as silicone, configuring the puck structure to be cleansed with soap and water with minimal effort. In an embodiment, a puck structure formed by silicone is not damaged by contact with water, soap, or a hydrophobic fluid. In an example, puck structure 100 may be formed of two halves joined together, such by a weld or injection molding. The puck structure 100 may have a cover 102 perforated by a plurality of vents 108. In an example, FIG. 2 is a front view of a puck structure 100. In an example, FIG. 3 is a side view of a puck structure 100. In an example, a puck structure 100 is symmetrical such that FIG. 2 is a front view of the puck structure 100 from either face. In an example, a puck structure 100 is symmetrical such that FIG. 3 is a side view of the puck structure 100 from either side. A vent of a plurality of vents 108 may transition into a ledge of a plurality of ledges 106, such a ledge maintaining an indentation in the cover 102 as shown in FIGS. 1-3. In an example, FIG. 4 is a top view of a puck structure 100. In an example, a puck structure 100 is symmetrical such that FIG. 4 is a top view or a bottom view of the puck structure 100. Symmetricity provides an advantage in that it functions the same regardless of orientation, thereby providing ease of use, especially in certain circumstances, such as a user preparing the puck structure 100 in a darkened room or while tired. In an alternate embodiment, an asymmetric puck may be oriented in a particular way to provide different scent characteristics, such as a more direct path for scent molecules or faster diffusion of a scented fluid than if the asymmetric puck was in a different orientation. A ledge of a plurality of ledges 106 may not penetrate the cover 102 to an interior space 104. A cavity 110 may separate a cover 102 from the front from a cover from a back of the puck of the puck structure 100. A sidewall 112 may define an aperture of an interior space 104. A cutout notch 114 may also define an interior space 104.

In an example, a puck structure 100 has a length between approximately 45 mm and approximately 55 mm. The puck structure 100 may have a width between approximately 50 mm and approximately 60 mm. The puck structure 100 may have a thickness between approximately 5 mm and approximately 13 mm. A puck structure may be of a disk body. In some examples, the front of a puck structure 100 is substantially circular or elliptical, having an average diameter between approximately 45 mm and approximately 60 mm. In an embodiment, a front of a puck structure 100 is of an elliptical shape with an aspect ratio of major and minor diameters of approximately 9:11. In an example, an edge of a front of the disk body tapers to meet an edge of a back of the disk body. In an example, a vent of a plurality of vents may have a length between approximately 10 mm and approximately 22 mm. A ledge of the plurality of ledges 106 may have a length between approximately 3 mm and approximately 15 mm. A vent of a plurality of vents 108 and a ledge of a plurality of ledges 106 may have a width between approximately 1 mm and approximately 3 mm. In an example, a sidewall 112 defining an aperture has a diameter between 10 mm and 15 mm. A notch 114 may have a length between 1 mm and 3 mm and a width between 1 mm and 3 mm.

Figure 5:
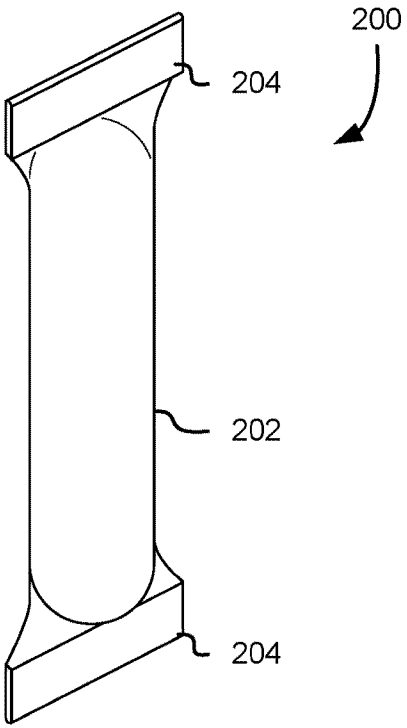
FIG. 5 is a front perspective view of a cartridge structure in accordance with an embodiment.

FIG. 5 is a front perspective view of a cartridge structure 200 in accordance with at least one embodiment. In an example, a cartridge structure 200 comprises a cartridge body 202. A cartridge body 202 may terminate in a tab 204. A tab 204 may be the result of a manufacturing process where a capsule is inserted into a tube-like shell comprising the cartridge body and the shell is trimmed such that the ends of a tube are sealed. Sealing the shell around a capsule may be accomplished with an adhesive along a sealing seam, sewn seam, or by applying heat, such as to effect a weld at a seam or shrink effect around the capsule. A cartridge structure may be a container of a capsule as described herein. A capsule may be a container of fluid as described herein. In an embodiment, a tab 204 improves a user's grip on the cartridge structure 200 and provides a surface by which a user may push the cartridge structure 200 into a puck structure 100. In an embodiment, a tab 204 provides a surface by which a user may pull the cartridge structure 200 to remove the cartridge structure 200 from a puck structure 100. In an example, a tab 204 is firm such that the tab 204 allows force to be applied to a cartridge structure without compromising structural integrity of a contained capsule, such as capsule 400, within the cartridge structure.

Figure 6:
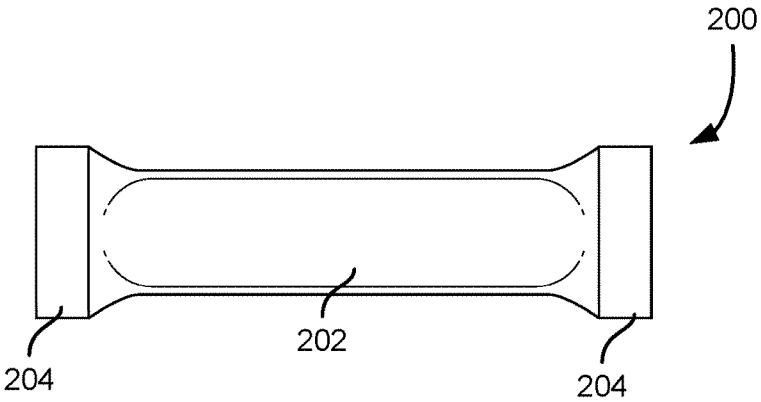
FIG. 6 is a front view of a cartridge structure in accordance with an embodiment.
Figure 8:
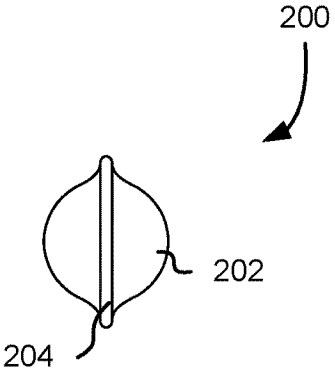
FIG. 8 is a top view of a cartridge structure in accordance with an embodiment.
Figure 7:
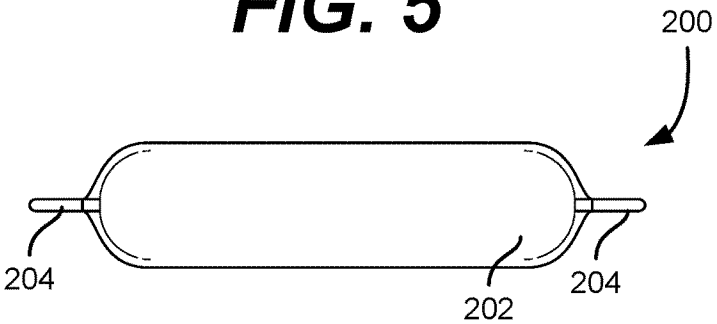
FIG. 7 is a side view of a cartridge structure in accordance with an embodiment.

In an example, a cartridge body 202 is substantially rounded terminating in a flattened tab 204 on each end. In an example, FIG. 6 is a front view of a cartridge structure 200. In an example, a cartridge structure 200 is symmetrical such that FIG. 6 is a front view or a back view of the puck structure 100. In an example, FIG. 7 is a side view of a cartridge structure 200. In an example, a cartridge structure 200 is symmetrical such that FIG. 7 is a right side view or a left side view of the cartridge structure 200. In an example, FIG. 8 is a top view of a cartridge structure 200. In an example, a cartridge structure 200 is symmetrical such that FIG. 8 is a top view or a bottom view of the cartridge structure 200.

In an example, a cartridge structure 200 has a length between approximately 45 mm and approximately 55 mm. The cartridge structure 200 may have a width between approximately 5 mm and approximately 15 mm. The cartridge structure 200 may have a thickness between approximately 5 mm and approximately 15 mm. In an example, a cartridge body 202 may have a length between approximately 33 mm and approximately 40 mm. The cartridge body 202 may have a width between approximately 5 mm and approximately 15 mm. The cartridge body 202 may have a thickness between approximately 5 mm and approximately 15 mm. In an example, a tab 204 may have a length between approximately 4 mm and approximately 7 mm. The tab 204 may have a width between approximately 12 mm and approximately 14 mm. The tab 204 may have a thickness between approximately 0.1 mm and approximately 1 mm. A cartridge structure may have boundaries or dimensions such that the cartridge structure approximates the space defined by sidewalls 112 of a puck structure.

Figure 10:
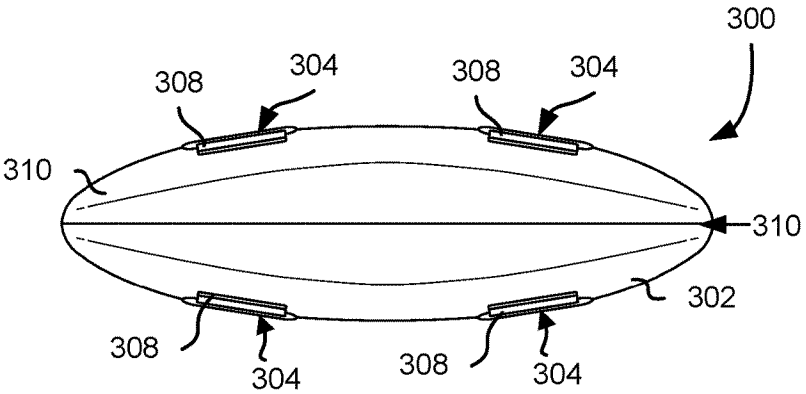
FIG. 10 is a top view of a pillow structure in accordance with an embodiment.
Figure 12:
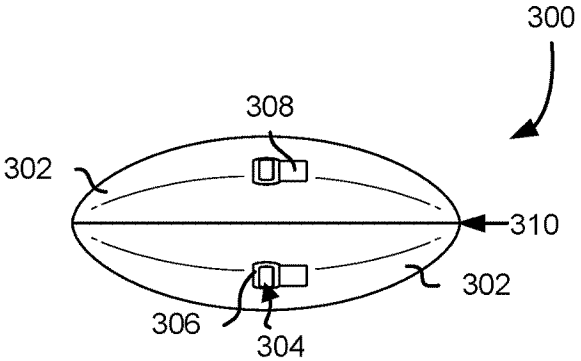
FIG. 12 is a side view of a pillow structure in accordance with an embodiment.
Figure 9:
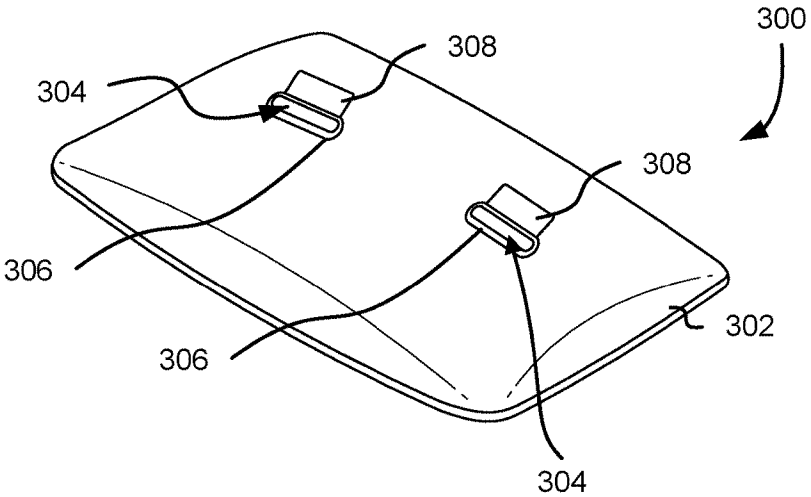
FIG. 9 is a front perspective view of a pillow structure in accordance with an embodiment.
Figure 11:
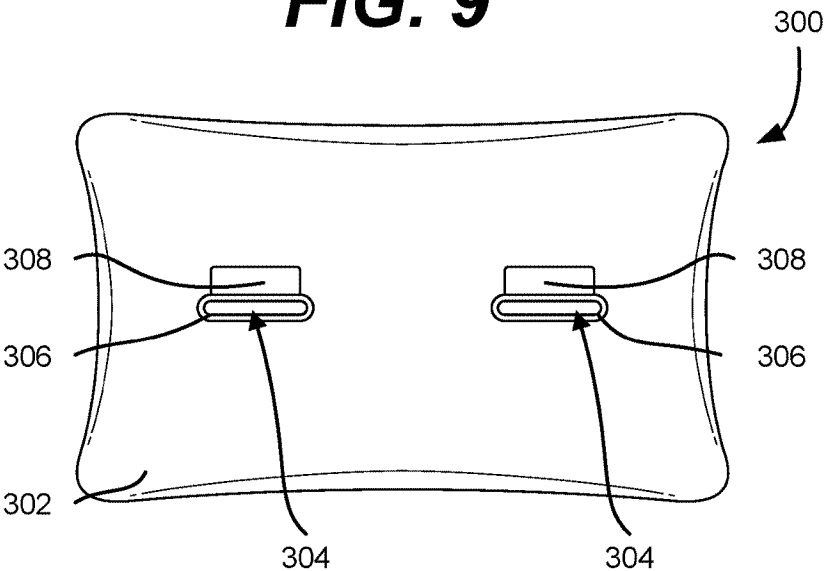
FIG. 11 is a front view of a pillow structure in accordance with an embodiment.

FIG. 9 is a front perspective view of a pillow structure 300 in accordance with at least one embodiment. In an example, FIG. 10 is a top view of a pillow structure 300, where a pair of covers 302 contain pillow fill. In an example, a pillow structure 300 is symmetrical such that FIG. 10 is a top view or a bottom view of the pillow structure 300. In an example, FIG. 11 is a front view of a pillow structure 300. In an example, a pillow structure 300 is symmetrical such that FIG. 11 is a front view or a back view of the pillow structure 300. FIG. 12 is a side view of a pillow structure 300 in accordance with an embodiment. In an example, a pillow structure 300 is symmetrical such that FIG. 12 is a right side view or a left side view of the pillow structure 300.

Pillow structure 300 may have a cover 302. In an example, a pocket 304 is defined by pocket seam 306 may interrupt the cover 302. In an example, a pocket 304 may interrupt the cover 302 at approximately a central location relative to the width of the cover 302. In an example, a pocket 304 may interrupt the cover 302 at approximately an equidistant location relative to the edge of the cover 302 and another pocket of a plurality of pockets along a length of the cover 302. In an example, a plurality of pockets provides alternative or additional placement of one or more puck structures within a pillow structure 300. A flap 308 may correspond to a pocket 304. In an example, a flap 308 may be similarly size to cover a corresponding pocket 304. In an example, a cover 302 is interrupted by two pockets 304. A pillow structure 300 may be substantially symmetrical such that a plurality of pockets 304 on a front face as shown in FIG. 11 may be replicated on a back face. In an example, FIG. 10 illustrates four pockets 304 on a pillow structure 300, where each cover 304 comprises two pockets. In an example, FIG. 12 illustrates pockets 304 on a pillow structure 300, where the pockets 304 are mirrored about a seam 310 along a lateral axis or edge of the pillow structure 300. In an example, a portion of the seam 310 may be re-sealable, such as by a fastening mechanism, to form a re-sealable aperture. Examples of a fastening mechanism include a zipper, a hook and loop (e.g., Velcro®), a snap, or a button. A re-sealable aperture provides a user an opening by which to access a plurality of fill, such as to adjust mass of fill contained within the pillow structure 300.

Figure 14:
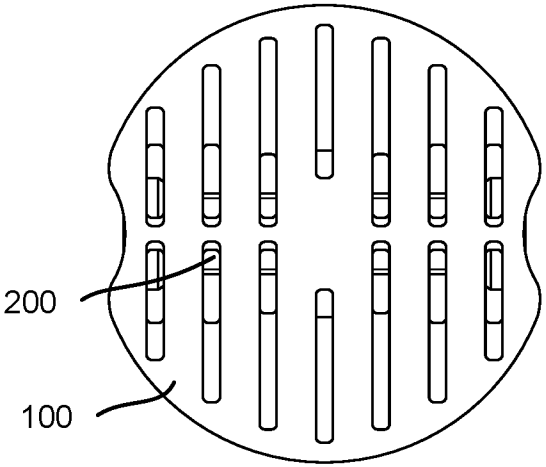
FIG. 14 is a front view of a puck structure and cartridge structure in accordance with an embodiment.
Figure 13:
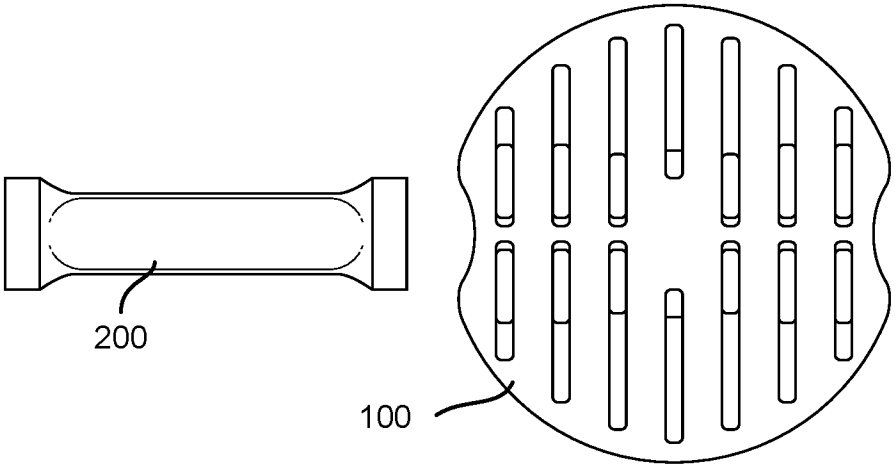
FIG. 13 is a front view of a puck structure and cartridge structure in accordance with an embodiment.
Figure 15:
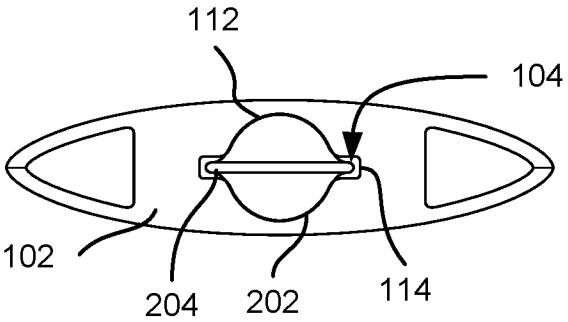
FIG. 15 is a top view of a puck structure and cartridge structure in accordance with an embodiment.

FIG. 13 is a front view of a puck structure 100 adjacent to a cartridge structure 200 in accordance with at least one embodiment. In an example, FIG. 14 is a front view of a puck structure 100 contained within a cartridge structure 200. FIG. 15 is a top view of a puck structure 100 contained within a cartridge structure 200 in accordance with at least one embodiment.

Figure 16:
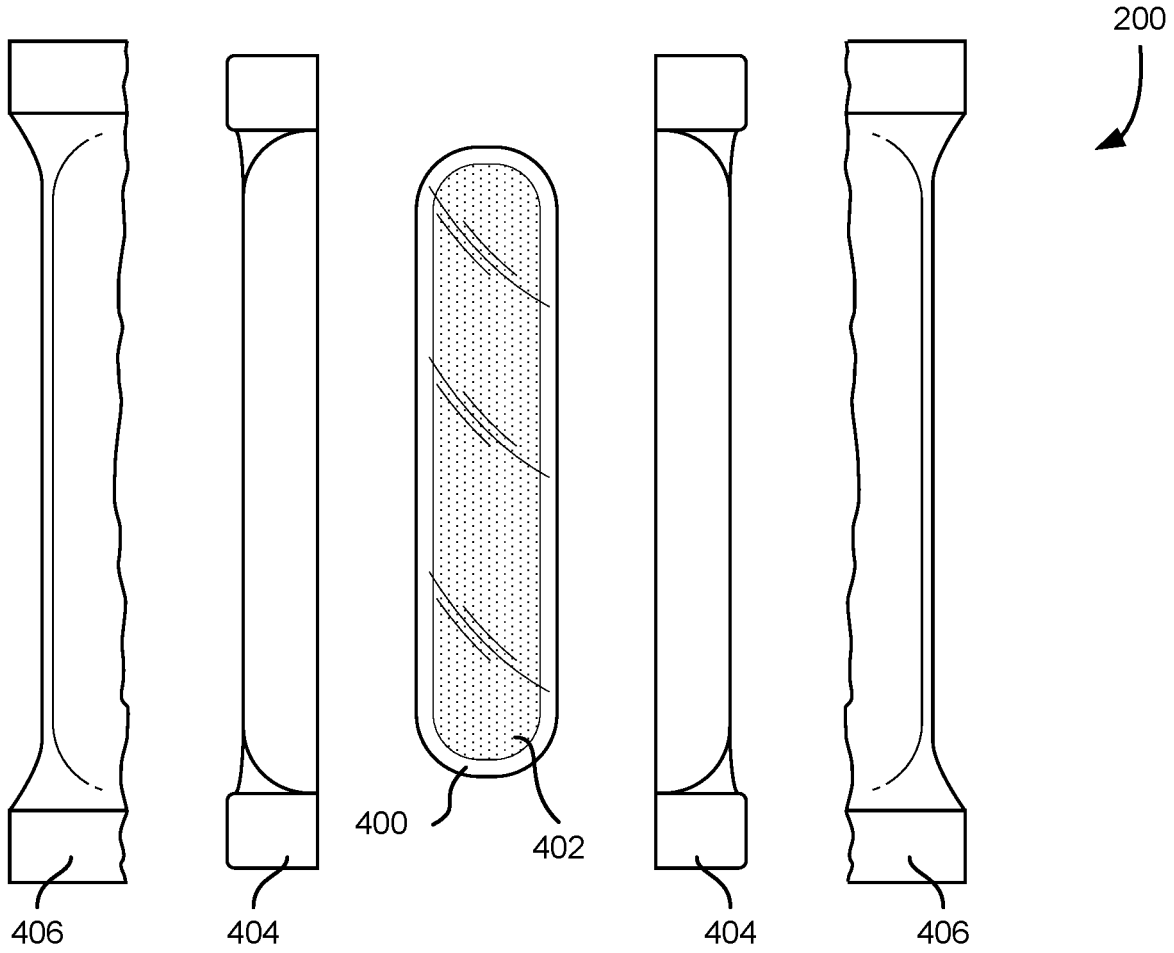
FIG. 16 is an exploded view of a cartridge structure in accordance with an embodiment.

FIG. 16 is an exploded front view of a cartridge structure 200 in accordance with at least one embodiment. In an example, a cartridge structure 200 contains a scented fluid 402 within a plurality of shell structures. In an example, the scented fluid 402 is contained within a capsule 400. A scented fluid may be a concentrated hydrophobic liquid containing volatile (easily evaporated at normal temperatures) chemical compounds from natural sources, such as plants, referred to as an "essential oil." As one skilled in the art will appreciate, essential oils are also known as volatile oils, ethereal oils, aetherolea, or simply as the oil of a natural source from which they were extracted. An essential oil is essential in the sense that it contains the essence of a fragrance, such as a characteristic fragrance of the plant from which the essential oil is derived. A scented fluid may be a manufactured or synthetic fragrance, or a combination of natural and synthetic compounds. In an embodiment, a scented fluid 402 includes lavender essential oils.

Figure 17:
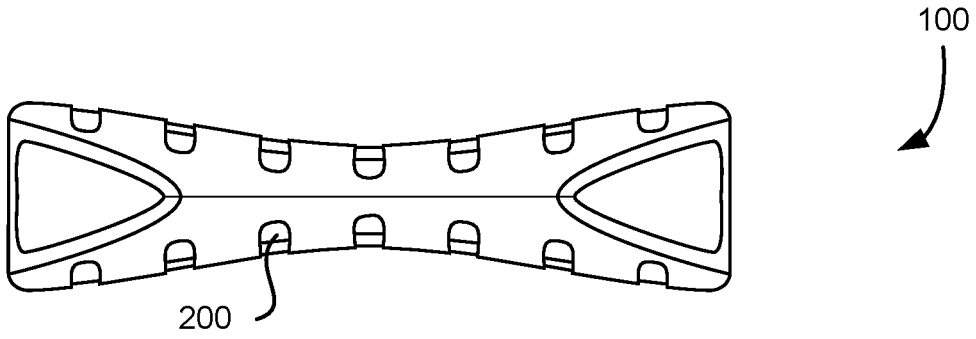
FIG. 17 is a side view of a partially compressed puck structure in accordance with an embodiment.

A capsule 400 may be formed by an inert material. A capsule 400 may be formed by a breakable material, such as glass or plastic, or a structure manipulable by a user with their hands to release the scented fluid 402, such as by breaking a seal or mechanically separating two or more parts of the capsule 400. A capsule 400 may be encompassed by a first shell 404. A first shell of a sheet of a permeable and absorbent material may be wrapped or fitted around a capsule 400 and sealed. In an example, a capsule may be inserted into a tube and the tube trimmed such that the ends of the tube extend beyond a capsule 400 so that the ends may form tabs of a cartridge structure. Sealing a permeable and absorbent material around a capsule may be accomplished with an adhesive along a sealing seam, sewn seam, or by applying heat, such as to effect a weld at a seam or shrink effect around the capsule. A first shell 404 may be formed by a material configured to absorb scented fluid and allow the scented fluid to pass through the material, such as natural or synthetic fibers including paper or cloth. For example, a cloth may be formed by cotton, wool, bamboo, polyester, nylon, etc., including a combination thereof. A first shell 404 may be further encompassed by a second shell 406 and so on. A second shell 406 may be fashioned from a similar absorbent material to that used by the first shell 404. A second shell may be formed from a natural or synthetic paper or cloth. In an example, a second shell 406 is fashioned from a more or less absorbent material to that used by the first shell 404. A capsule 400 may be fashioned from a material that, when intact, prevents a scented fluid 402 from passing through. A first shell 406 may be fashioned from a material that, when in contact with a scented fluid 402, allows the scented fluid 402 to pass through. FIG. 17 is a side view of a puck structure 100 when compressed with a cartridge structure 200 contained within.

In an embodiment, compressing a cartridge structure 200 with sufficient force results in a capsule 400 fracturing or otherwise causing scented fluid 402 contained within the cartridge structure 200 to be released into an interior chamber formed by the first shell 404. Scented fluid may permeate an inner shell, such as first shell 404. Scented fluid may permeate an outer shell, such as second shell 406. In an example, a more outer shell may be of a different permeability than an inner shell, such as by being of a different thickness or of different material. For example, an outer shell may be less permeable than an inner shell. In an example, scented fluid may be suspended in a cartridge structure 200 made from an absorbent material that is configured to provide increase surface area for scented fluid to aerate space surrounding a puck structure 100 containing the cartridge structure 200.

Figure 18:
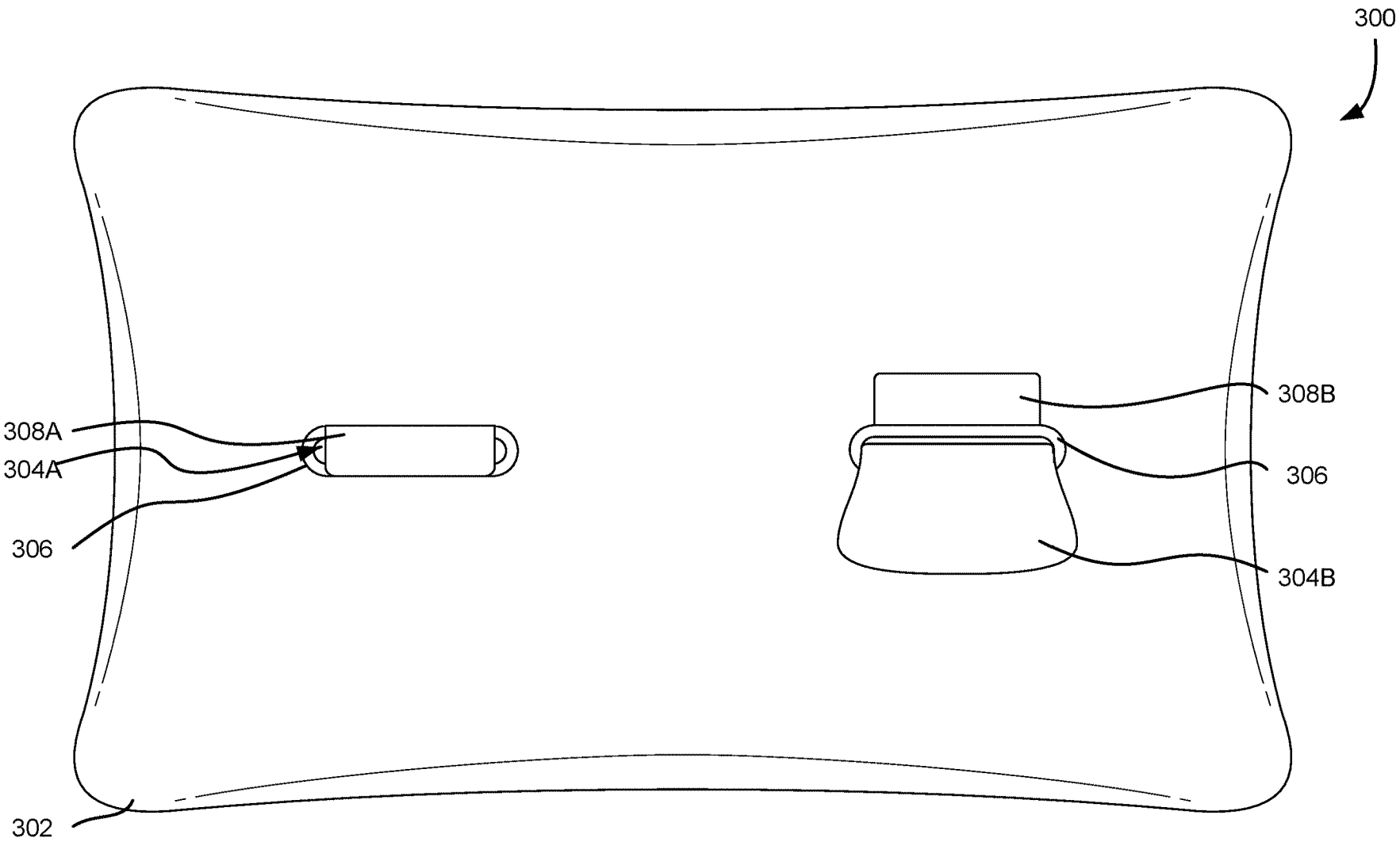
FIG. 18 is a front view of a pillow structure in accordance with an embodiment.

FIG. 18 is a front view of a pillow structure 300 in accordance with at least one embodiment. A pillow structure may be formed from a fabric, such as from natural or synthetic fibers or a combination thereof. In an example, a pillow structure may be formed from polyester. In an example and referring to a cover 302 of the pillow structure 300, a pocket seam 306 defines the location of a deployed pocket 304A and a closed flap 308A. With a deployed pocket 304A and a closed flap 308A, a contour of an exterior space of the pillow structure is uninterrupted when a container or puck is stored in the pocket. In an example and referring to a cover 302 of the pillow structure 300, a pocket seam 306 defines the location of a retracted pocket 304B and an open flap 308B. In an example, a pocket seam 306 may define a pocket opening between approximately 110 mm and approximately 130 mm in length and between approximately 17 mm and 29 mm in width. In an example, a pocket 304 may be between approximately 70 mm and approximately 90 mm in depth and between approximately 90 mm and 100 mm in length.

Figure 19:
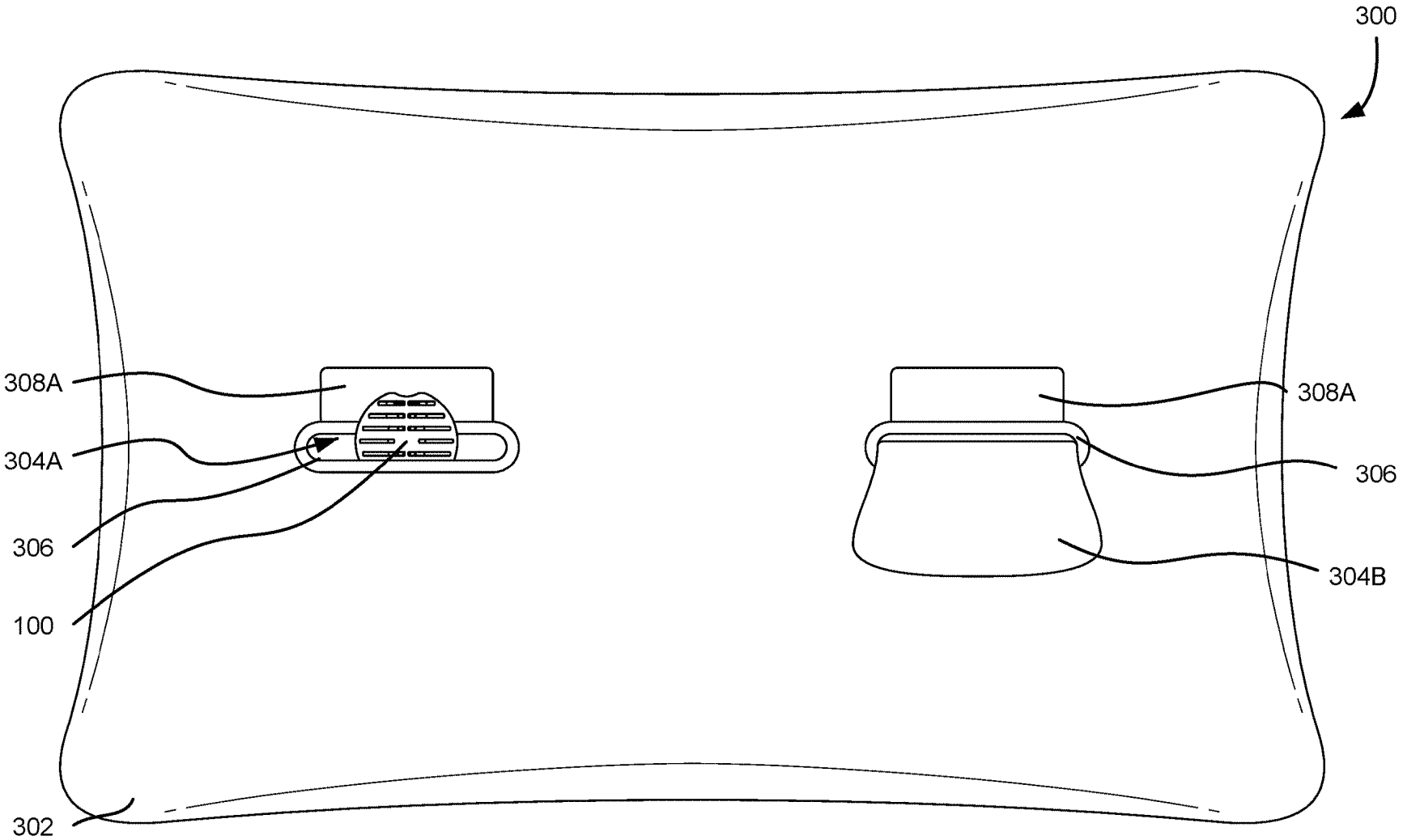
FIG. 19 is a front view of a pillow structure in accordance with an embodiment.
Figure 20:
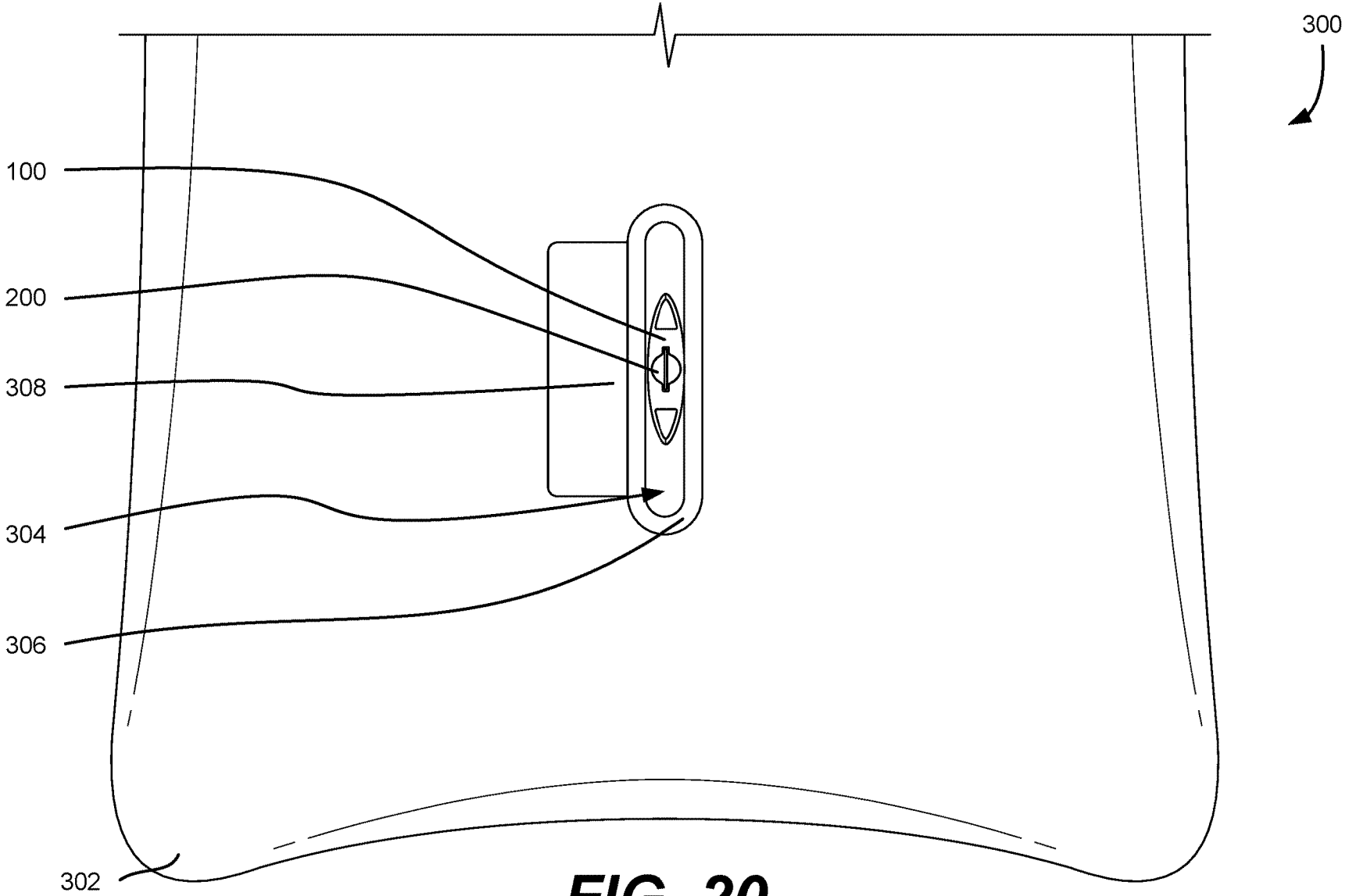
FIG. 20 is a front view of a pillow structure in accordance with an embodiment.
Figure 21:
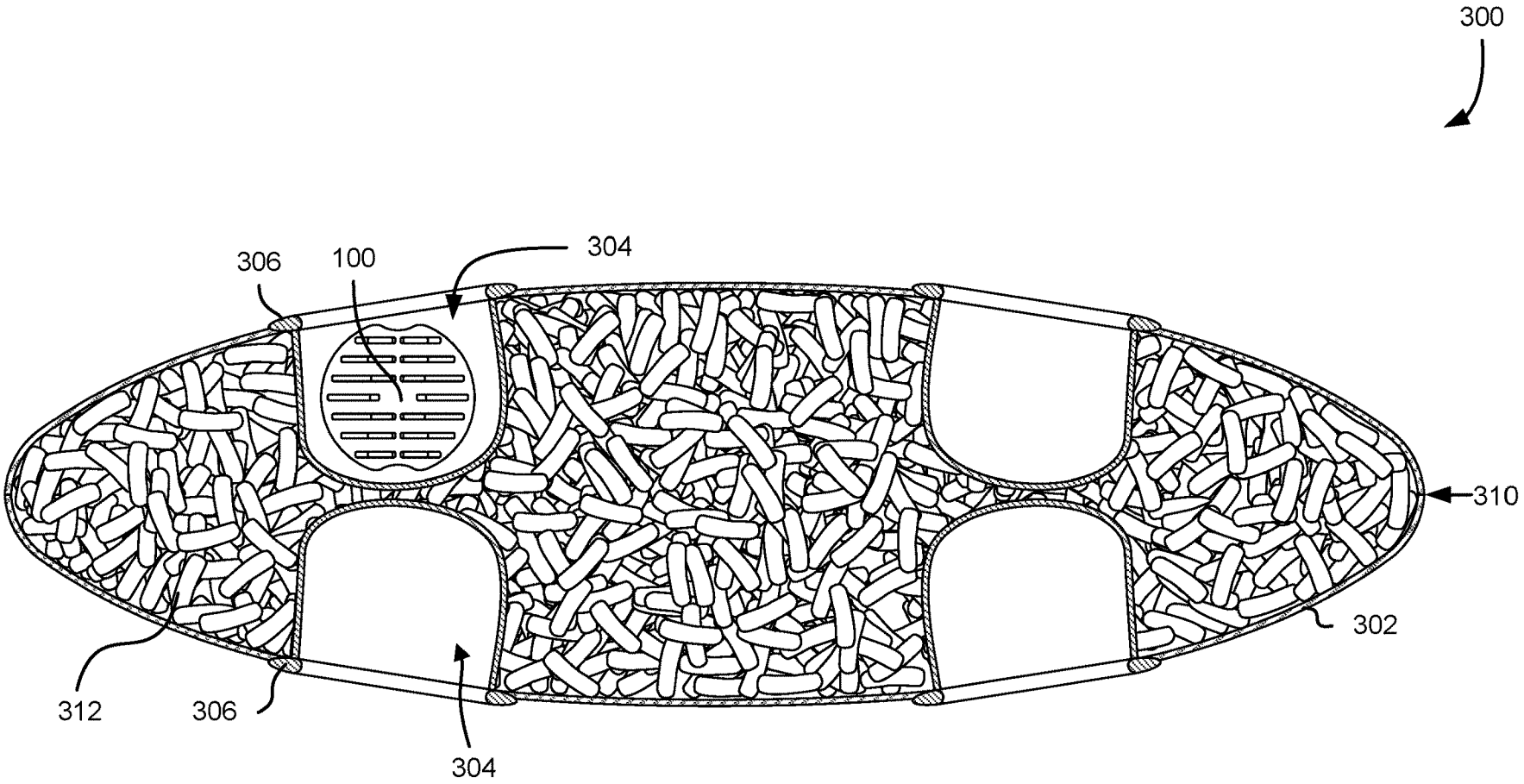
FIG. 21 is a top view of a cross-section of a pillow structure with a puck structure in accordance with an embodiment.

FIG. 19 is a front view of a pillow structure 300 in accordance with at least one embodiment including a puck structure 100 inserted into a deployed pocket 304A wherein the deployed pocket 304A is substantially parallel to a pillow cover 302. FIG. 20 is a front view of a pillow structure 300 in accordance with at least one embodiment including a puck structure 100 inserted into a deployed pocket 304A wherein the deployed pocket 304A is substantially orthogonal to a pillow cover 302. It will be appreciated by one skilled in the art that a deployed pocket 304A may be deployed into fill contained by a pillow cover 302 at any suitable angle. FIG. 21 is a cross-section top view of a pillow structure 300 in accordance with at least one embodiment. In an example, a cover 302 contains a plurality of fill 312. In an example, an inside portion of the deployed pocket 304A is in communication with the plurality of fill 312 while an outside portion of the deployed pocket 304A is configured to contain the puck structure 100 entirely within the pillow structure 300. In an example, an interior surface of a deployed pocket 304A continues an exterior portion of the case 302 while an exterior surface of a deployed pocket 304A continues an interior portion of the case 302, where the interior surface of the deployed pocket 304A is configured to accept the puck structure 100, where the exterior surface of the deployed pocket 304A is in communication with the plurality of fill 312. In an embodiment, a pocket structure may refer to a deployed pocket 304A.

A plurality of fill 312 may include natural or synthetic materials providing a cushioning effect or suitable for compression in a pillow application. Fill of a natural material may include down or feature fill, such as from a bird. Examples of natural material fill are fibers, hulls, or seeds, such as wool, cotton, buckwheat hull, kapok, or latex. Fill of synthetic materials may include polymer particles, small curled polyester fiber (down alternative), latex (including a combination of natural and synthetic latex), memory foam (such as polyurethane foam), micro-bead, or polyester fiber-fill. Fill may include shredded or particulate variations, uniformly or inconsistently sized, of natural or synthetic materials described herein. In an embodiment, a plurality of fill may include shredded memory foam, the shredded memory foam suitable for a pillow structure to accommodate a scent cartridge. A user of a pillow structure 300 may insert a puck structure 100 into a pocket 304 such that the pocket 304 is deployed within the plurality of fill 312 in an interior space bounded by covers 302 of the pillow structure 300. A cover seam 302 may be resealable such that a fastening mechanisms allows for changing the quantity of the plurality of fill 312 contained by the cover 302. A pillow structure 300 may be formed from two symmetrical halves of a pillow cover 302, joined along their edges. A pillow cover 302 may join two halves at a seam by a sewn seam, adhesive, or other joining means suitable for application with natural or synthetic fibers forming a cloth. A sewn seam may be of one or more stitches, including visible and hidden stitches. A hidden stitch may be referred to as an "invisible" or "nearly invisible" stitch, such as a ladder stitch.

Figure 22:
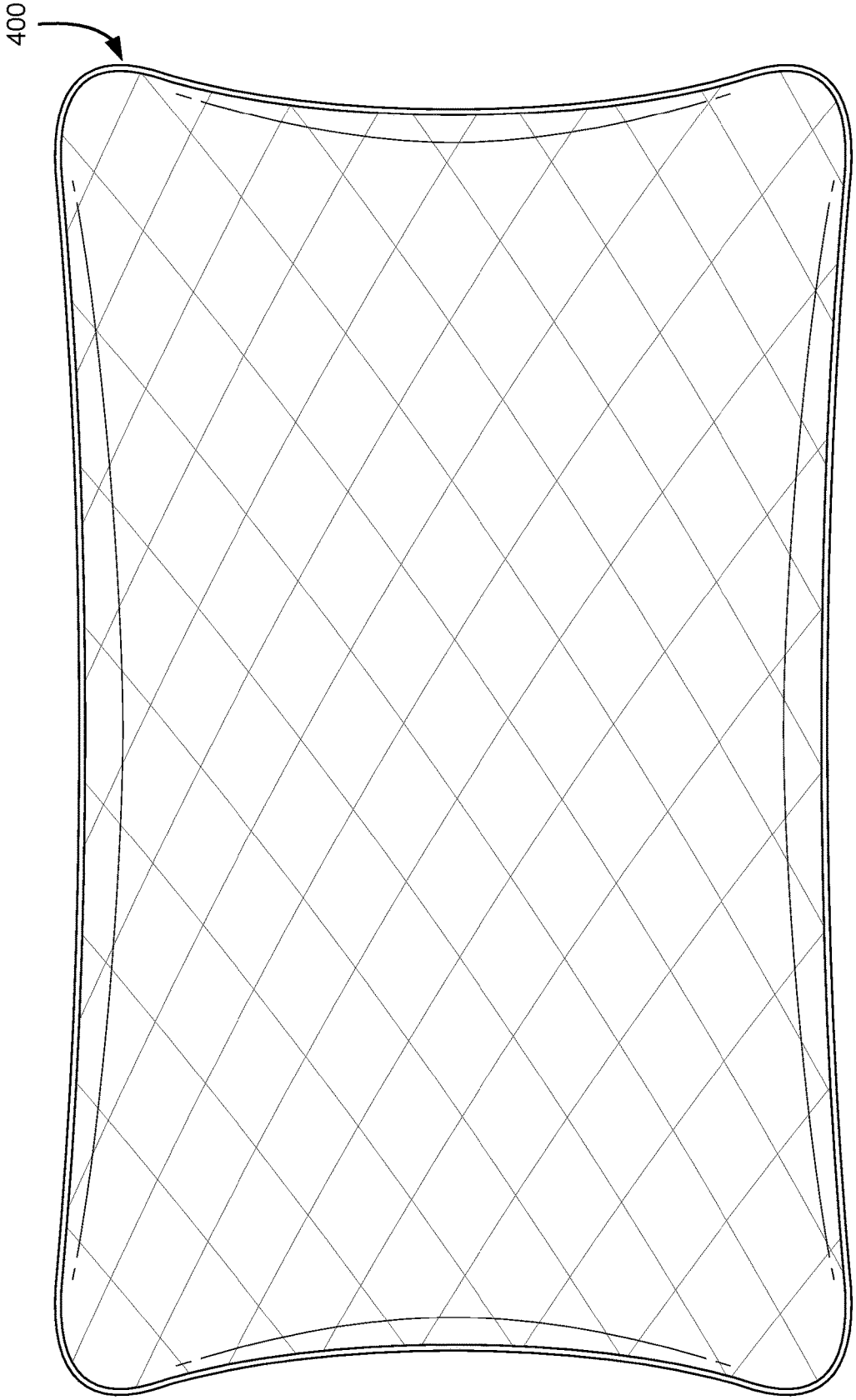
FIG. 22 is a front view of a pillow case structure in accordance with an embodiment.

FIG. 22 is a front view of a pillow case structure 400 in accordance with at least one embodiment. In an embodiment, a pillow case structure may be formed from cloth as described above. In an embodiment, a pillow case structure may be formed from a combination of cloth materials, such as 65% polyester and 35% viscose fiber from bamboo. In an example, a pillow case structure 400 is symmetrical such that FIG. 22 is a front view or a back side view of the pillow case structure 400. A pillow case structure may be formed from two symmetrical halves joined along their edges. A pillow case structure 400 may join two halves by a sewn seam (such as described herein), adhesive, or other joining means. A pillow case structure 400 may cover the pillow structure 300. In an example, a pillow case structure 400 may removeably cover the pillow structure 300 by utilizing one or more fastening mechanisms to allow the pillow case structure to be installed and uninstalled over the pillow structure 300.

When the puck structure 100 and cartridge structure 200 are configured to aerate space surrounding the puck with scented fluid 402 as discussed above, and the puck structure 100 and cartridge structure 200 are inserted into a deployed pocket 304A, the scented fluid 402 may be distributed among the plurality of fill 312 such that the scented fluid is diffused or aerated. In such a manner, a user of the pillow structure 300 may obtain aromatherapy by the scented fluid 402 being distributed by the cartridge structure 200, passing through the puck structure 100, and diffusing through the pillow structure 300. The scented fluid 402 may be broadcast from the cartridge structure 200 to a user's environment. In an example, the scented fluid 402 also passes through a pillow case structure 400 to be delivered to a user of the system including the puck structure 100, cartridge structure 200, pillow structure 300, and pillow case structure 400.

A pillow case structure 400 may form a cover around a pillow structure 300. A pillow case structure may be formed from a fabric of natural materials, synthetic materials, or a combination thereof as described herein. For example, a pillow structure may be formed from a combination of polyester and a viscose fiber from bamboo. A pillow case structure 400 may include a grid-like, cross hatching, or quilted pattern across surfaces of the pillow case structure 400. Such patterning provides the advantage of trapping air to provide an insulating effect, thereby maintaining temperature comfort of a user of the pillow case structure 400. In an example, a pillow case structure 400 may have a length between approximately 60 mm and approximately 80 mm. The pillow case structure 400 may have a width between approximately 48 mm and approximately 50 mm. The pillow case structure 400 may have a material thickness between approximately 2 mm and approximately 5 mm. As will be appreciated by one skilled in the art, a pillow case structure 400 may be sized to cover typical sized pillows, such as a standard pillow, a queen pillow, or a king pillow. As will be appreciated by one skilled in the art, a pillow structure 300 may be sized similarly to typical sized pillows, such as a standard pillow, a queen pillow, or a king pillow.

The specification and drawings are, accordingly, to be regarded in an illustrative rather than a restrictive sense. It will, however, be evident that various modifications and changes may be made thereunto without departing from the broader spirit and scope of the present disclosure as set forth in the claims. Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the present disclosure to the specific form or forms disclosed but, on the contrary, the intention is to cover all modifications, alternative constructions, and equivalents falling within the spirit and scope of the present disclosure, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. Similarly, use of the term "or" is to be construed to mean "and/or" unless contradicted explicitly or by context. The terms "comprising," "having," "including," and "containing" are to be construed as open-ended terms (i.e., meaning "including, but not limited to,") unless otherwise noted. The term "connected," when unmodified and referring to physical connections, is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. The use of the term "set" (e.g., "a set of items") or "subset" unless otherwise noted or contradicted by context, is to be construed as a nonempty collection comprising one or more members. Further, unless otherwise noted or contradicted by context, the term "subset" of a corresponding set does not necessarily denote a proper subset of the corresponding set, but the subset and the corresponding set may be equal. The use of the phrase "based on," unless otherwise explicitly stated or clear from context, means "based at least in part on" and is not limited to "based solely on."

Conjunctive language, such as phrases of the form "at least one of A, B, and C," or "at least one of A, B and C," (i.e., the same phrase with or without the Oxford comma) unless specifically stated otherwise or otherwise clearly contradicted by context, is otherwise understood within the context as used in general to present that an item, term, etc., may be either A or B or C, any nonempty subset of the set of A and B and C, or any set not contradicted by context or otherwise excluded that contains at least one A, at least one B, or at least one C. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}, and, if not contradicted explicitly or by context, any set having {A}, {B}, and/or {C} as a subset (e.g., sets with multiple "A"). Thus, such conjunctive language is not generally intended to imply that certain embodiments require at least one of A, at least one of B and at least one of C each to be present. Similarly, phrases such as "at least one of A, B, or C" and "at least one of A, B or C" refer to the same as "at least one of A, B, and C" and "at least one of A, B and C" refer to any of the following sets: {A}, {B}, {C}, {A, B}, {A, C}, {B, C}, {A, B, C}, unless differing meaning is explicitly stated or clear from context. In addition, unless otherwise noted or contradicted by context, the term "plurality" indicates a state of being plural (e.g., "a plurality of items" indicates multiple items). The number of items in a plurality is at least two but can be more when so indicated either explicitly or by context.

The use of any and all examples or exemplary language (e.g., "such as") provided herein is intended merely to better illuminate embodiments of the present disclosure and does not pose a limitation on the scope of the present disclosure unless otherwise claimed. No language in the specification should be construed as indicating any non-claimed element as essential to the practice of the present disclosure.

Embodiments of this disclosure are described herein, including the best mode known to the inventors for carrying out the present disclosure. Variations of those embodiments may become apparent to those of ordinary skill in the art upon reading the foregoing description. The inventors expect skilled artisans to employ such variations as appropriate, and the inventors intend for embodiments of the present disclosure to be practiced otherwise than as specifically described herein. Accordingly, the scope of the present disclosure includes all modifications and equivalents of the subject matter recited in the claims appended hereto as permitted by applicable law. Moreover, any combination of the above-described elements in all possible variations thereof is encompassed by the scope of the present disclosure unless otherwise indicated herein or otherwise clearly contradicted by context.

What is claimed is:

1. An aromatherapy system, comprising:

a cartridge structure comprising a permeable outer shell encompassing an absorbent inner shell, the permeable outer shell and the absorbent inner shell configured to diffuse a scented fluid from an interior portion of the absorbent inner shell to a space defined by a space outside of the permeable outer shell, the scented fluid configured to release from a container when crushed, the container encompassed by the absorbent inner shell;

a puck structure configured to, when compressed, allow the container to be crushed and comprising a disk body including a plurality of apertures, wherein at least a first aperture is configured to accept the cartridge structure such that the cartridge structure is entirely housed within the disk body, wherein at least a second aperture is configured to allow the scented fluid to diffuse from the cartridge structure to a cover of the disk body, and wherein the puck structure is formed from silicone, the puck has a length between approximately 45 mm and approximately 55 mm, a width between approximately 50 mm and approximately 60 mm, and a thickness between approximately 5 mm and approximately 13 mm; and a pillow structure comprising:

a case encompassing a plurality of foam fill, the plurality of foam fill in an interior portion of the case; and a pocket that extends into an interior space defined by the case such that at least some of the foam fill is between an outer surface of the case and the puck structure.

2. The aromatherapy system of claim 1, wherein the scented fluid comprises essential oils associated with lavender.

3. The aromatherapy system of claim 1, wherein the puck structure further comprises a plurality of sidewalls configured to approximate boundaries of the cartridge structure.

4. The aromatherapy system of claim 1, wherein:

the permeable outer shell further comprises a tab extending beyond the container; and the puck structure further comprises a notch configured to accept the tab.

5. The aromatherapy system of claim 1, wherein an edge of a front of the disk body tapers to meet an edge of a back of the disk body.

6. The aromatherapy system of claim 1, wherein the pillow structure further comprises a re-sealable aperture along a seam of the pillow structure, the re-sealable aperture configured to allow adjustment to mass of the plurality of foam fill.

7. An aromatherapy system, comprising:

a container structure configured to store fluid and, when the container structure is constricted, release the fluid;

a pillow structure configured to store the container structure by a pocket, the pocket configured to extend to an interior space of the pillow structure such that a contour of an exterior space of the pillow structure is uninterrupted when the container is stored in the pocket; and a puck structure configured to, when compressed, allow the container structure to be crushed, the puck structure comprising a disk body including a plurality of apertures, wherein the puck structure is formed from silicone, the puck has a length between approximately 45 mm and approximately 55 mm, a width between approximately 50 mm and approximately 60 mm, and a thickness between approximately 5 mm and approximately 13 mm.

8. The aromatherapy system of claim 7, wherein the fluid comprises essential oils.

9. The aromatherapy system of claim 7, wherein at least a first aperture is configured to accept the container structure such that the container structure is entirely housed within the disk body, and wherein at least a second aperture is configured to allow the fluid to diffuse from the container structure to a surface of the disk body.

10. The aromatherapy system of claim 9, wherein the puck structure further comprises a plurality of sidewalls configured to approximate dimensions of the container structure.

11. The aromatherapy system of claim 9, wherein the pillow structure is further configured to store the puck structure.

12. The aromatherapy system of claim 11, wherein an edge of a front of the disk body tapers to meet an edge of a back of the disk body.

13. The aromatherapy system of claim 7, wherein the pillow structure further comprises a re-sealable aperture along a seam of the pillow structure, the re-sealable aperture configured to allow adjustment to mass of a plurality of foam fill stored within the pillow structure.

* * * * *